United States Patent [19]

Spitzer

[11] 4,081,337

[45] Mar. 28, 1978

[54] ELECTROLYTIC PRODUCTION OF HYDROGEN

[76] Inventor: Robert Spitzer, 1700 Broadway, New York, N.Y. 10019

[21] Appl. No.: 789,999

[22] Filed: Apr. 22, 1977

[51] Int. Cl.[2] ..... C25B 1/02

[52] U.S. Cl. ..... 204/129; 423/551

[58] Field of Search ..... 204/129; 423/551

[56] References Cited

U.S. PATENT DOCUMENTS 3,409,520 11/1968 Bolmer ..... 204/129

*Primary Examiner*—R. L. Andrews

*Attorney, Agent, or Firm*—Kenyon & Kenyon, Reilly, Carr & Chapin

[57] ABSTRACT

A cyclic electrolytic process for the manufacture of hydrogen from carbonaceous material such as coal, agricultural wastes and garbage to produce commercial hydrogen. An alakli metal sulfate is reduced to an alkali metal sulfide by reaction of the sulfate and carbonaceous fuel at an elevated temperature. The sulfide and impurities derived from the fuel are digested with an aqueous solution to dissolve the sulfide and separate out the impurities. The solution of the alkali sulfide is added to electrolytic cells in which an electric current is utilized to generate hydrogen at the cathode while oxidizing the sulfide substantially to sulfate at the anode. The cell electrolyte temperature is greater than 150° C and less than 350° C. Under these conditions the polarization problem encountered in hydrogen/oxygen cells is substantially avoided. The alkali sulfate is then separated from the electrolyte stream exiting from the electrolytic cells, reduced again by burning with fuel and recycled to the electrolytic cell.

14 Claims, 1 Drawing Figure

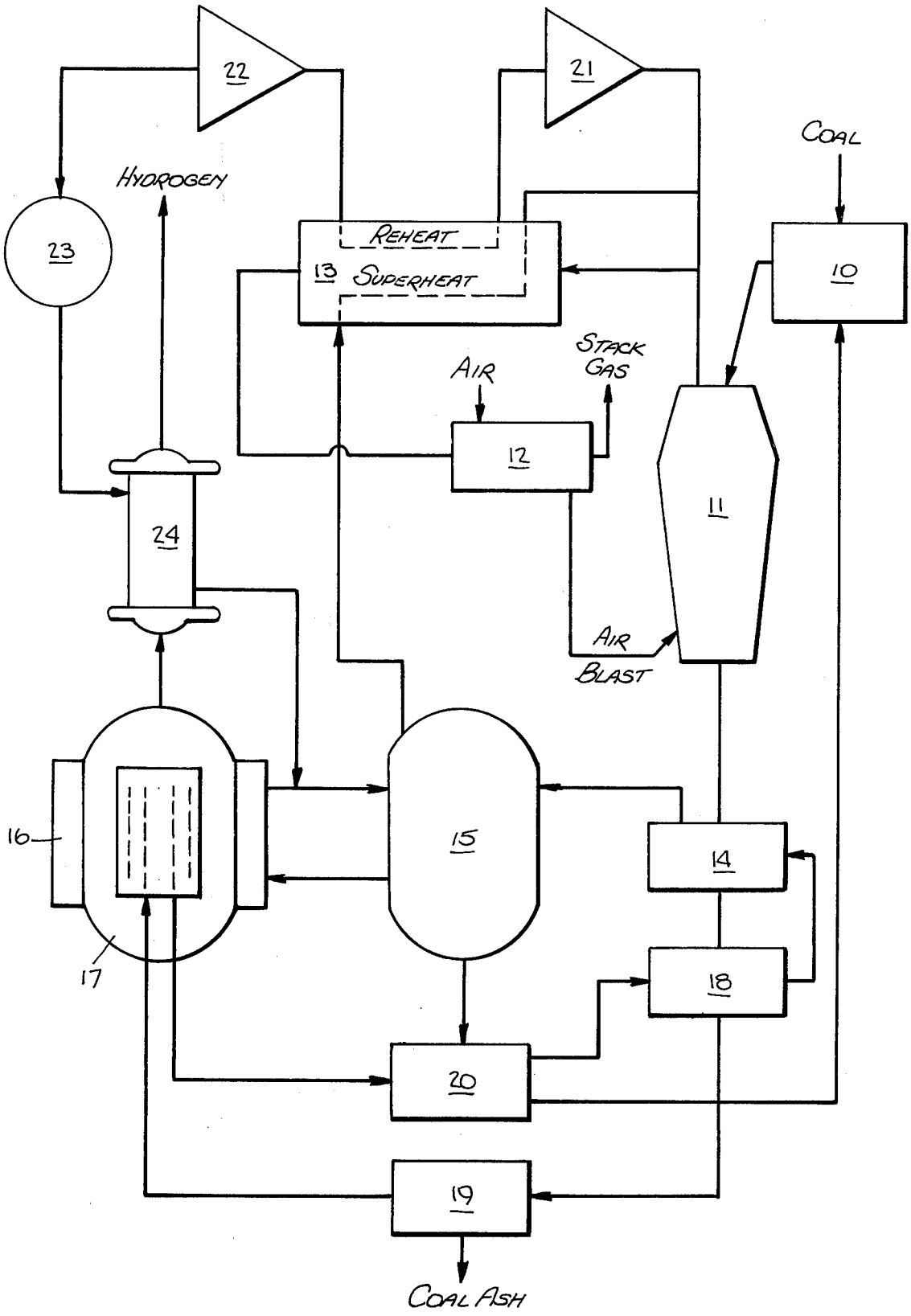
22
21
COAL
HYDROGEN
23
REHEAT
13
SUPERHEAT
10
STACK GAS
AIR
12
11
24
AIR BLAST
16
15
14
17
18
20
19
COAL ASH

ELECTROLYTIC PRODUCTION OF HYDROGEN

BACKGROUND OF THE INVENTION

An economic source of industrial hydrogen is required to produce liquid and gaseous fuels from coal, for hydrodesulfurization of heavy or light oils, for the hydrogenation of mineral or fatty oils, and for the operation of fuel cells. Whereas industrial hydrogen has been produced largely from natural gas and naphtha, recent shortages and price movements have dictated a change to the use of coal as a raw material.

Accordingly, hydrogen is produced by the gasification of coal with oxygen and steam. This technique is used to produce a synthesis gas which is cleaned to remove acid gases and then reacted in stages with steam over catalysts to convert the carbon monoxide to hydrogen, and carbon dioxide is separated as a by-product of this reaction. The process of obtaining hydrogen from coal involves a complex sequence of operations and entails losses of considerable energy from the fuel in the process. The technical difficulties are even greater if the process is carried out under pressures of from 50 to 200 atmospheres, which leads to problems in injecting fuel solids and in handling oxygen.

Hydrogen is also produced by the electrolysis of water from an aqueous solution of potassium hydroxide. Although the minimum energy of decomposition corresponds with a cell potential of 1.229 volt, the voltage of commercial hydrogen cells is more than twice this minimum potential because of electrode polarization and the electrical resistance of the electrolyte and the diaphragm which is necessary to separate the hydrogen from the oxygen which is generated at the anode.

It is an object of this invention to provide an improved process for preparing hydrogen from carbonaceous fuels. This and other objects are set forth in greater detail in the following description of the invention.

DESCRIPTION OF THE INVENTION

This invention is directed to producing commercial hydrogen at high current density with good current and energy efficiency using an anode-depolarizing electrolyte which is regenerated with low cost dirty fuels. Another object is to carry out this electrolytic hydrogen production in cells which are of components which are moderate in cost of material and assembly.

This invention includes the use of an electrolytic cell for the production of electrolytic hydrogen at an elevated temperature and pressure in a sulfide/sulfate electrolyte. The sulfide serves as an anode depolarizer to produce sulfate as an anodic product of the electrolytic cell. The sulfate is removed from the cell and reduced in a furnace to replace the sulfide at the rate of its transformation in the electrolytic cells. Thus a continuous process is provided to convert fuel to hydrogen with the sulfide/sulfate components being recycled through the process.

Cathodic generation of hydrogen in this invention as in the prior art is by the deprotonization of water molecules which migrate to the electrode against a counterflux of hydroxyl ions or by proton transfer from the anodes. This produces a concentration of hydroxyl and alkali metal ions at the cathode surface.

At the anodes of the prior art, protons are generated in oxygen electrode reactions leading to oxygen gas formation in a reaction sequence. This sequence is responsible for a substantial oxygen electrode over-voltage which increases with the anode current density. In the present invention, the protons are produced in electrochemical reactions of sulfide ions in the electrolyte. These reactions involve addition of oxygen atoms of the water molecules to the sulfide to produce sulfite and sulfate and the production of protons which are carried to the cathode.

This electrochemical reaction involves a polarization owing to concentration of sulfate at the anode and depletion of sulfide and hydroxyl ions. On the other hand the polarization potential at equivalent current density is substantially less than that of the oxygen electrode. The thermodynamic potential of a cell consisting of a hydrogen and a sulfide half-cell electrode is 0.218 volt to be imposed to generate the hydrogen. The actual potential required for the generation of hydrogen in a cell at 2 amp/sq. cm. is less than 0.5 volts compared with 2.0 to 3.0 volts for the hydrogen/oxygen cell.

To obtain the very low cell potential indicated above, it is necessary to employ elevated temperatures above 150° C. to overcome the anode polarization which is obtained at lower temperatures. This polarization is from an accumulation of elemental sulfur in the vicinity of the anode. The overvoltage may vary from a few tenths of a volt to more than 2.0 volts, depending on the current density and the rate at which the cell voltage is applied.

Among the products of anodic oxidation of alkaline sulfide solutions are sulfur and polysulfides at low current density, and at higher current density primarily sulfate and some dithionate with little or no polysulfides. Only a small amount of thiosulfate is produced. The anode reactions which lead to sulfur and polysulfide are obtained with very little overvoltage and the polysulfide is reducible at the cathode leading to low current efficiency for hydrogen.

At a current density of somewhat above 0.1 amp/sq. cm. the cell potential at temperatures below about 80° C is about 2.5 volt and the anode products are sulfate and lesser amounts of dithionate and thiosulfate. Under these conditions there is no advantage in energy utilization over the conventional hydrogen/oxygen cell. In the presence of polysulfides up to $Na_2S_3$ there is an increase in cell current at a cell potential of about 2.5 volt, with substantially the same anodic products.

According to the present invention, in the electrolysis of a solution of alkali sulfide at a temperature above 100° C and preferably about 200° C the anode polarization described above is substantially eliminated and the product of anodic oxidation of sulfide is substantially all sulfate.

The terms alkali sulfate and alkali sulfide in the context of this specification are intended to include the sulfates and sulfides of sodium, potassium as the preferred alkali metals, and also the compounds of lithium, cesium and rubidium.

The sulfate concentration becomes increasingly greater in the absence of electrolyte bleed off until the electrolyte is saturated with respect to alkali sulfate which then accumulates as a fine crystalline precipitate. This precipitate is maintained in suspension, preferably by moderate circulation of electrolyte within the electrolytic cells. To avoid a concentration of the precipitate to an extent of seriously reduced fluidity the electrolyte and suspended salt from the cells is clarified by filtration, centriguration or wet cyclone separation, the clarified effluent being returned to recirculate within the cells and so complete a flow path circuit.

The temperature of the electrolyte is maintained by a pressurization of the cells and electrolyte system so that this pressure is substantially in excess of the vapor pressure of the electrolyte at the electrolytic cell temperature. Inasmuch as for many of its uses, or for its storage, the hydrogen may be required to be a pressure of up to about 200 atmospheres it is preferred that the cell and electrolyte system should be operated at the desired pressure. The cell potential is elevated by 118 milivolts by the additional work to release the hydrogen for each ten-fold increase of pressure but this is partially offset by a reduction of cell resistance because of the reduction of bubble volume in the cells.

When hydrogen is generated in an alkali sulfide electrolyte as described above, the sulfate produced at the anode may migrate to the cathode and there undergo reduction. However the extent of cathodic sulfate reduction would not be such as to seriously impair current efficiency if the cell is so constructed and so operated as to keep the prevalent sulfate anolyte out of contact with the cathode.

In the clarification of the electrolyte in accordance with this invention the alkali sulfate precipitate is periodically or continuously removed and recovered and the solution is then refortified by addition of an equivalent quantity of alkali sulfide to replace that consumed in producing the sulfate. The alkali metal sulfide is produced by furnace reduction of the sulfate with the carbonaceous fuel.

There are in the prior art a number of methods for the furnace reduction of alkali-metal sulfates depending on the character of the carbonaceous reductant. In one method the alkali sulfate, e.g. salt cake, is piled in alternate layers with coke in a shaft furnace and the molten alkali sulfide matte is collected on a hearth under the furnace charge. In another method the alkali sulfate is heated with coke or other carbonaceous material in a direct fired rotary kiln.

For the best energy efficiency it is necessary to provide an intimate mixture of the sulfate and reducing material and induce the reaction at the lowest temperature. The gaseous products are then primarily carbon dioxide and water vapor and under these conditions the energy of reduction, including fuel value of the reductant, is approximately equal to the heat of combustion of the hydrogen which is produced provided it is assumed that there is substantially complete recovery of waste heat in the product gases.

A preferred method is to mix dried powder of the alkali sulfate with pulverized coal and convert the mixture to briquettes. The briquettes or pellets or extrusions are reduced in a shaft furnace or other heating means with a maximum temperature of about 1000° C above the blast while charging and blasting at rates to obtain a low temperature of about 275° C at the top of the furnace. As is known in the prior art the capacity of such a reduction furnace may be improved by the use of a fuel, e.g., residual oil with the blast, as well as by use of oxygen-enriched and/or preheated air.

It is not essential to conduct the furnace reduction of the alkali metal sulfate at atmospheric pressure but it is one of the advantages of this invention that the operations involving dirty fuels may be conducted at ambient pressure while the hydrogen is generated at high pressure. It is also an advantage that the major proportion of the ash impurities are discharged in a filter cake and that the sulfur is discharged in concentrated, easily recoverable form with a minor proportion of the ash in furnace gases at ambient pressure and moderate temperatures.

Although the foregoing describes reduction with coal, other reductants such as agricultural wastes, garbage and the like can be used as reductants in apparatus adapted from pulp mill technology.

This invention is operable over wide ranges of electrolyte concentration, pressure and temperature but as a practical matter a minimum concentration of 5%, as sodium sulfide, and a minimum temperature of 150° C, may be specified.

The preferred range of conditions are a concentration of about from 20% to 30% or 35% as sodium sulfide, a temperature of about from 250° to 400° C and a pressure of about from 20 to 200 atmospheres.

This invention is operable also over a wide range of cathode current density from 5 amperes per square foot (0.5 ampere per square meter), increasing the current density in accordance with the hydrogen demand if hydrogen storage is not available, or in accordance with the availability of electrical energy when storage of hydrogen is provided. The cells producing hydrogen in accordance with this invention may also be maintained in standby condition during peak load periods while hydrogen is furnished entirely from storage. In this manner, with provision of hydrogen storage this invention may be used in load balancing and to utilize off peak power.

There exists a wide variety of electrolytic cell types in which this invention may be conducted. For example, a suitable cell would contain an electrode configuration of woven or expanded metal electrodes with electrolytic insulator separator means holding apart these electrodes while permitting the free circulation of the electrolyte.

While there are various available materials of construction for the electrolytic cells and electrodes, an embodiment highly resistant to attack by the sulfide of the electrolyte is metallic chromium, preferably as a coating on the anodes. Also suitable for anodes are chromium-iron alloys. Cathodes may be constructed of carbon steel.

Various configurations of anodes and cathodes are suitable for the cells for carrying out the process of this invention, including closely spaced alternating electrode sheets. Preferably, however, the electrodes should provide extended surfaces and minimum impediment to circulation and release of hydrogen in accordance with well known principles, e.g. foraminous forms including coils, woven screens.

Minimum anode/cathode spacing consistent with absence of physical contact is desirable to minimize the electrolyte resistance and this is provided by suitable electrode supporting means.

The cells for carrying out this invention may be suitably of carbon steel in the form of enclosures suitable for holding the assembled electrodes and the electrolyte and for resisting the pressure of the cell contents, carrying away the hydrogen and providing electrical connection with the electrodes, as well as provision for circulation of electrolyte by inlet and outlet means.

Means for controlling the cell temperature are provided by thermostatically controlled heating or cooling of the electrolyte preferably external to the cells. Control of cell pressure is by manostat control of at least one valve controlling the discharge of hydrogen when the cells are operated at substantially constant current load or, where the demand for hydrogen is variable, manostatic control is through control of the cell current through appropriate electrical equipment, e.g. multitap transformers.

Inasmuch as the voltage of each cell may be approximately ½ volt it is necessary to provide electrical connections for the series flow of current. The hydrogen is preferably conveyed from the cells in parallel to join in a header pipe. This is similar to the method used in the electrolytic production of chlorine and other gases. This requires the electrical insulation of the gas conveyance means and structural supporting means by techniques of design which are well understood in the art of electrolytic gas generation.

Insofar as some cell inefficiency is inevitable that part of the electrical energy input which is above the thermodynamic minimum for a hypothetical reversible reaction goes to maintaining the cell temperature to balance radiation losses which should be minimized by compact cell design and insulation.

Thermal energy of the cell above the requirements for maintaining the cell temperature should be recovered as mechanical and electrical energy. This may be, according to this invention, by utilizing the cell electrolyte coolant as a working medium in an energy producing cycle.

Specifically the coolant/working medium may be water/steam. This will be in heat exchange relation with the cell electrolyte, e.g. by circulating the coolant through jackets which surround and enclosed the cells and/or by circulating the electrolyte through a waste heat boiler producing steam which may be expanded in a condensing steam turbine. Exhaust from the turbine should be condensed at the lowest practicable temperature and the cold condensate may be placed in heat exchange relation with the electrolytic hydrogen to cool this gas, condense its moisture and recover the sensible and latent heat of the moist hydrogen in sensible heat in the condensate prior to its return to the waste heat boiler in the manner of an economizer.

The attached Figure illustrates an embodiment of this invention. Finely divided coal is mixed with sodium sulfate and the mixture is compressed to form briquettes in a mixer-press 10. The briquettes are fired in a reduction furnace 11. Air is passed through heater 12 to provide a stream of hot air which is fed into the bottom of the reduction furnace. The hot gases from the furnace are removed overhead and passed through a heat exchanger 13, then through the air heater and finally discharged.

Molten sodium sulfide and impurities are withdrawn from the bottom of the furnace and passed with water into a first holding vat 14 which contains a concentrated aqueous solution of sodium sulfide, and from which the vapor generated by the heat of mixing is fed to a steam drum 15. The liquid from the steam drum is passed through the jacket 16 which surrounds the electrolytic cell 17, and back into the steam drum. The hot sodium sulfide solution from vat 14 is further diluted with water in vat 18. This dilution is exothermic and the heat of dilution preheats the solution going to the pressurized electrolytic cell.

A recirculating stream of sodium sulfide is maintained between the holding tanks 14 and 18 to maintain the concentration of the former to a high level such as about 60%, and the latter to a concentration of about 20%. The discharge from separator 18 is sent to a filter 19 from which coal ash is removed and a stream of sodium sulfide solution is passed into the electrolytic cell. The effluent from the electrolytic cell, containing suspended sodium sulfate, is passed through a filter 20. The filter 20 discharges a sodium sulfide stream which goes to the second holding tank 18 and a sodium sulfate stream which is transferred to the mixer-press.

The steam from the drum passes through the heat exchanger, a high pressure turbine 21, back through the heat exchanger, and then through a low pressure turbine 22, and to a condenser 23. The condenser effluent passes through a cooler 24 in heat exchange with the hydrogen from the electrolytic cell. The condensed water then passed with the effluent stream from the electrolytic cell into the steam drum.

This invention has been described in terms of specific embodiments set forth in detail, but it should be understood that these are by way of illustration only and that the invention is not necessarily limited thereon. Modifications and variations will be apparent from this disclosure and may be resorted to without departing from the spirit of this invention, as those skilled in the art will readily understand. Accordingly, such variations and modifications of the disclosed process are considered to be within the purview and scope of this invention and the following claims.

What is claimed is:

1. A cyclic electrolytic process of utilizing the energy of dirty carbonaceous fuels to produce commercial hydrogen which comprises:

(a) reducing an alkali sulfate to alkali sulfide by reaction of the sulfate and dirty fuel at an elevated temperature, (b) digesting the sulfide and impurities derived from said dirty fuel with aqueous solution, or water, to dissolve the sulfide, and separate out said impurities, (c) adding the solution of said alkali sulfide to an electrolytic cell in which an electric current is utilized to generate hydrogen at the cathode while oxidizing sulfide substantially to sulfate at the anode, (d) separating alkali sulfate from an electrolyte stream exiting from said electrolytic cells, and (e) recycling the alkali sulfate to the reducing procedure of said step (a).

2. The method of claim 1 in which the cell electrolyte temperature is greater than 150° C and less than 400° C.

3. The process of claim 2 in which the electrolytic cell is maintained at a pressure above the vapor pressure of the electrolyte and up to about 200 atmospheres.

4. The method of claim 3 in which said pressure is about between 20 to 200 atmospheres.

5. The method of claim 3 in which the electrolyte concentration of sulfate is about between 20 to 30%.

6. The method of claim 1 in which the concentration of alkali sulfate is maintained above its saturation point in the electrolyte.

7. The method of claim 6 in which the electrolyte is maintained at about a steady concentration of sulfide and sulfate by continuously adding alkali sulfide and removing alkali sulfate.

8. The method of claim 1 in which the alkali sulfate is sodium sulfate.

9. The method of claim 1 in which the alkali sulfate is potassium sulfate.

10. The method of claim 1 in which the dirty fuel is coal.

11. The method of claim 1 in which the dirty fuel is coal char.

12. The method of claim 1 in which the dirty fuel is agricultural waste or garbage.

13. The method of claim 1 in which the electrolyte concentration of sulfide is greater than 5% and less than 35% expressed as sodium sulfide equivalence.

14. The method of claim 1 in which the alkali sulfate is intimately mixed with said fuel at an elevated pressure to prepared a solid form which is heated by contact with heated gases to effect reduction of said alkali sulfate.

* * * * *

UNITED STATES PATENT AND TRADEMARK OFFICE

CERTIFICATE OF CORRECTION

PATENT NO. : 4,081,337

DATED : March 28, 1978

INVENTOR(S) : Robert Spitzer

It is certified that error appears in the above-identified patent and that said Letters Patent are hereby corrected as shown below:

In the Abstract, line 4, delete "alakli" and substitute -- alkali --.

Column 2, line 15, after "hydrogen" insert -- electrode --.

Column 2, line 67, delete "centriguration" and substitute -- centrifugation --.

Column 8, line 5, delete "prepared" and substitute -- prepare --.

Signed and Sealed this

*Fifteenth* Day of *August 1978*

[SEAL]

*Attest:*

RUTH C. MASON
*Attesting Officer*

DONALD W. BANNER
*Commissioner of Patents and Trademarks*